United States Patent [19]

Stäheli et al.

[11] Patent Number: 4,648,754

[45] Date of Patent: Mar. 10, 1987

[54] ARRANGEMENT FOR TRANSPORTING FIBER FLOCKS

[75] Inventors: Paul Stäheli, Wilen b. Wil; Urs Stähli, Turbenthal; Fritz Knabenhaus, Winterthur, all of Switzerland

[73] Assignee: Maschinenfabrik Rieter A.G., Winterthur, Switzerland

[21] Appl. No.: 770,650

[22] Filed: Aug. 28, 1985

[30] Foreign Application Priority Data

Aug. 28, 1984 [CH] Switzerland ..... 04119/84

[51] Int. Cl.[4] ..... B65G 53/04; B65G 53/58

[52] U.S. Cl. ..... 406/156; 406/183; 406/3; 137/597; 137/875; 19/105

[58] Field of Search ..... 406/11-13, 406/155, 156, 159-161, 191-195, 1, 2, 28, 3; 137/597, 875, 883, 861; 19/105

[56] References Cited

U.S. PATENT DOCUMENTS

| | | | |
|---|---|---|---|
| 3,029,477 | 4/1962 | Wildbolz et al. | 406/156 X |
| 3,326,609 | 6/1967 | Auten et al. | 406/183 X |
| 3,408,115 | 10/1968 | Reitever | 406/183 X |
| 3,649,082 | 3/1972 | Wise | 19/105 X |
| 3,851,924 | 12/1974 | Roberson et al. | 406/156 X |

FOREIGN PATENT DOCUMENTS

| | | | |
|---|---|---|---|
| 1685613 | 4/1967 | Fed. Rep. of Germany . | |
| 1510413 | 1/1970 | Fed. Rep. of Germany . | |
| 2102095 | 1/1971 | Fed. Rep. of Germany | 406/156 |
| 370680 | 8/1963 | Switzerland . | |
| 853158 | 11/1960 | United Kingdom | 406/1 |

*Primary Examiner*—Joseph F. Peters, Jr.
*Assistant Examiner*—L. E. Williams
*Attorney, Agent, or Firm*—Michael J. Striker

[57] ABSTRACT

An arrangement for pneumatically transporting fiber material flocks through respective chutes to individual carding machines includes a duct which bounds an internal passage that communicates with the chutes, the chutes extending downwardly from the duct. A plurality of control elements is arranged in the passage, respective two of such control elements being situated between each adjacent two of the chutes. Each of the control elements has a substantially plate-shaped control member which is pivotally mounted at the bottom region of the duct, and a block member that extends substantially at a right angle to the control member remotely from the pivot axis and extends toward and into the respective chute. The control element can be pivoted into and arrested in any selected pivoted position, including a closed position in which the block member thereof substantially completely prevents the flow of the transporting medium past the same. The transporting medium carrying the flocks is introduced into either one or into both of the ends of the passage, and the positions of the control elements are so adjusted as to obtain flow speeds upstream of the respective chutes in the range substantially between 2 and 10 m/s; the transporting medium volume can also be adjusted toward this goal. Those of the control elements which are situated between two adjacent chutes may be mounted on a common pivot axle.

6 Claims, 2 Drawing Figures

ARRANGEMENT FOR TRANSPORTING FIBER FLOCKS

BACKGROUND OF THE INVENTION

The present invention relates to pneumatic transportation arrangements in general, and more particularly to a pneumatic transporting arrangement for fiber flocks.

There is already known, for instance, from the German published patent application No. 15 10 413, a pneumatic transportation system for fiber flocks for supplying a plurality of carding devices in a transverse-feed fashion by means of a transporting medium through a duct of a constant cross section, a plurality of control members being arranged in the interior of such duct and being operative for controlling the flow of the transporting medium. In this system, an extraction roll is provided at the upper end of each chute which communicates with the interior of the duct and extends downwardly from the duct to the respective carding device. The extraction roll engages the flocks carried by the transporting medium and feeds them into the respective chute. The control members are constructed and arranged to serve as diverter plates that are pivotally mounted in the interior of the duct and divert the flocks from the respective extraction roll in the event that, in the absence of such diverting action, too many flocks would be captured by the extraction roll and fed thereby into the respective chute. This construction has the disadvantage that strong vortices form at the downstream ends and downwardly of the diverter plates, so that an undesirable accumulation of fiber flocks can form between the diverter plate and the surface of the duct which is situated below the diverter plate. Further drawbacks of this known construction are that the adjustability of the diverter plate is limited, that flock material can be fed into the duct only in one direction, and that full closure of the duct cannot be effected.

Furthermore, German published patent application No. 16 85 613 discloses a feed installation with a transport duct, wherein the cross-sectional areas of the duct passages situated between the chutes continuously increase from one chute to the next one. This serves to slow down the transporting air at the input end of the respective chute and to accelerate it again at the output end. In order to provide for control of the speed of the transporting air, there are provided insert plates arranged at the input and output openings of the feed chutes and extending normal to the direction of flow of the transporting air. The requirement for the insertion of such insert plates to adjust or control the flow speed is operationally impractical. Also, the disposition of the insert plates normal to the flow direction causes strong air turbulence and thus an increase in the energy required to produce the transport flow.

Swiss patent disclosure No. 370680 discloses an air duct in which pivotable diverter flaps are provided at the locations of the feed chutes and at the downstream side thereof with respect to the direction of the air flow. These diverter flaps serve to divert the fiber flocks into the respective feed chutes. The air acceleration caused by these diverter flaps occurs only at the rear side of the feed chutes and thus only after the fiber flocks have already substantially passed the chute opening. This, of course, is disadvantageous since it detracts from the precision of control of the amount of fiber flocks delivered into the respective chutes.

SUMMARY OF THE INVENTION

Accordingly, it is an object of the present invention to avoid the disadvantages of the prior art.

More particularly, it is an object of the present invention to provide an arrangement for feeding fiber flocks to a plurality of carding devices, which does not possess the disadvantages of known arrangements of this type.

Still another object of the present invention is so to construct the arrangement of the type here under consideration as to achieve a high degree of control over the amount of fiber flocks fed into the individual feed chutes.

It is yet another object of the present invention so to design the arrangement of the above type as to afford an improved versatility in comparison with the conventional constructions of fiber flock transporting arrangements.

A concomitant object of the present invention is to develop an arrangement of the above type which is relatively simple in construction, inexpensive to manufacture and install, easy to use, and reliable in operation nevertheless.

In pursuance of these objects and others which will become apparent hereafter, one feature of the present invention resides in an arrangement for pneumatically transporting fiber flocks to a plurality of carding devices, this arrangement comprising an elongated duct having a top wall, a bottom wall and two opposite side walls interconnecting the top and bottom walls and bounding a cross-sectionally rectangular passage which has two longitudinally spaced ends and is of a constant cross-sectional area throughout; a plurality of chutes each associated with one of the carding devices and communicating with the passage and extending downwardly from the duct; means for introducing a transporting medium carrying the fiber flocks into at least one of the ends of the passage for flow longitudinally of the passage and for supplying the fiber flocks to the respective chutes; a plurality of control elements each including a substantially plate-shaped control member and a substantially plate-shaped block member rigid with the control member and extending substantially at a right angle thereto; means for mounting the control elements in the duct for pivoting about respective pivot axes longitudinally spaced from the respective chutes and arranged at the bottom wall in such a manner that two of the control elements are arranged between each two of the chutes in a mirror-image fashion with their control members extending from the mounting means toward one of the chutes each and that the block members thereof extend toward the respective chute and into the latter in all pivoted positions of the respective control element; and means for pivoting the control elements between the pivoted positions thereof and for arresting the control elements in selected ones of the pivoted positions.

A particular advantage of the arrangement of the present inventions as described so far is that six or even more chutes can be fed with the flock material via a single duct with a relatively small quantity of air. The control elements prevent accumulation of the fiber material in clumps at the region of the downstream chutes. Moreovar, uniform filling of all chutes with the fiber flock material is achieved. Above all, transportation of the fiber flocks in the passage of the duct can be changed from one direction to the opposite direction, if so desired or dictated by circumstances. In this way, possibilities of use of the arrangement of the present invention, and its versatility, are increased.

Even though only carding devices are specifically mentioned here, the arrangement of the present invention is usable in the same or similar manner for cards and carding engines for long staple fibers.

According to an advantageous aspect of the present invention, one of the pivoted positions is a closed position in which the blocking member of the respective control element blocks the flow of the transporting medium past the same. This renders it possible to supply the fiber flock to only some but not all of the chutes, and to supply different fiber flock materials to different groups of the chutes at the same time. To this end, it is proposed by the present invention so to construct the introducing means as to introduce the transporting medium with one type of the fiber material into the one end of the passage, and the same transporting medium but with another type of the fiber material into the other end of the passage. Then, there is provided controlling means for controlling the pivoting means which so controls the latter that those of the control elements which are situated between those of the chutes that are to be the last chutes for the respective fiber material are in their closed positions in which the blocking members thereof substantially block the flow of the respective transporting medium past the same. The number of the carding devices in the one group which is fed with the fiber material of one kind, and the number of the carding devices supplied with the fiber material of the other kind, can be selected and varied at will by adjustment of the respective control elements. This construction thus enables greater flexibility of the arrangement with reference to the distribution of the fiber material or material to the respective carding devices or feeding chutes.

A particularly simple and otherwise advantageous construction of the arrangement is obtained when the mounting means includes a common pivot axle for the respective two of the control elements that are arranged between the respective adjacent chutes.

It is further advantageous when there is further provided means for so controlling at least one of the introducing and pivoting means as to achieve transporting medium flow speed upstream of each of the chutes in the range between 2 m/sec and 10 m/sec, preferably between 3 m/sec and 8 m/sec. Advantageously, the passage has a width of substantially 17 cm and a height of substantially 40 cm.

It is further advantageous when the block members are curved and each of them is centered on a curvature axis that coincides with the pivoting axis of the mounting means. The bottom wall of the duct may advantageously be provided with openings that are located underneath and in juxtaposition with the control members of the respective control elements. The mounting means includes respective axles which support the control members of the respective control elements for the pivoting on the side walls of the duct.

The novel features which are considered as characteristic of the invention are set forth in particular in the appended claims. The improved transporting arrangement itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENT

Figure 2:
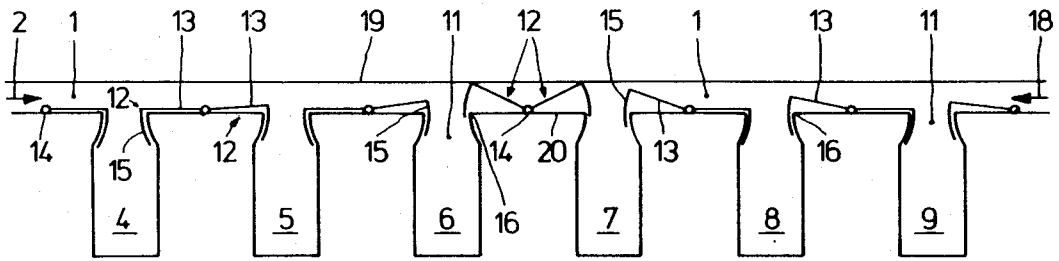
FIG. 2 is a view similar to that of FIG. 1 but of a modified construction of the feeding arrangement.
Figure 1:
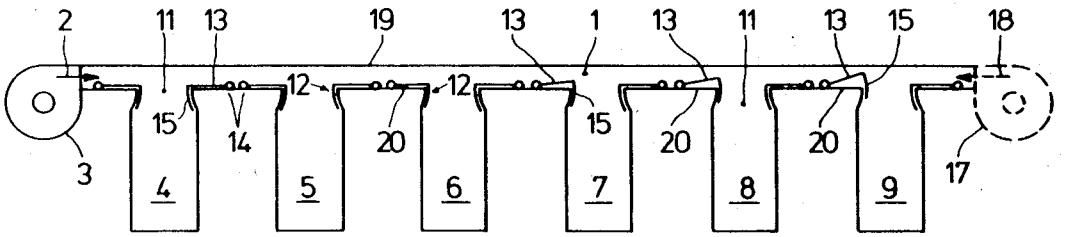
FIG. 1 is a diagrammatic longitudinal sectional view of a feeding arrangement of the present invention.

Referring now to the drawing in detail, it may be seen that FIGS. 1 and 2 thereof depict two constructions of a feeding arrangement of the present invention which are similar to one another in so many respects that the same reference numerals can be and have been used to identify corresponding parts.

Each of FIGS. 1 and 2 shows an elongated duct 1 of constant, rectangular section, the height of which is greater than its width. Fiber flocks are transported through these ducts 1, in the direction of an arrow 2 by means of a transport medium, for example air, moved by means of a blower 3 (shown only in FIG. 1). Underneath the duct 1, there are arranged feed chutes 4, 5, 6, 7, 8 and 9. Each of the chutes 4, 5, 6, 7, 8 and 9 is provided, for instance, with feed rolls at its lower end, by means of which feed rolls the fiber material is fed to a carding machine.

The feed rolls and carding machine are of conventional constructions and located in a known manner, so that they need not be, nor are they, shown in the drawing. Still further chutes can be provided in additon to the illustrated chutes 4 to 9. At the top region of each chute 4 to 9, respectively, the bottom wall of the duct 1 has an opening 11 that is adapted in size and dimensions to the corresponding chute 4, 5, 6, 7, 8 and 9. Each feed chute 4 to 9 has a rectangular cross section, the long sides of which (transverse to the longitudinal direction of the carding machine) lie parallel to the plane of the drawing and thus parallel to the duct 1. The feed system disclosed here is therefore of the so-called transverse feed type.

Between each pair of neighboring chutes 4 to 9, there are provided two control elements 12. Each control element 12 comprises a control plate 13 which is pivotally mounted on a pivot shaft or axle 14 arranged at right angles to the longitudinal direction of the duct 1. Each respective control element 12 is adjustable into any desired pivoted position within the duct 1 and is fixable in any such pivoted position. Of the two control elements 12 located between respective adjacent ones of the chutes 4 to 9, each is associated with one chute 4, 5, 6, 7, 8 and 9. For example, referring to the control elements 12 between the chutes 6 and 7, the left-hand control element 12 as seen in the drawing, and thus also its control plate 13, is associated with the chute 6, and the right-hand control element 12 as considered in the drawing, and its control plate 13, are associated with the chute 7.

Each control plate 13 extends from its pivot axle 14 towards the chute 4 to 9, respectively, with which it is associated. The pivot axles 14 are located at the bottom of the duct 1. In the open position of the respective control element 12 or its control plate 13, the latter is in its horizontal position resting at the bottom of the duct 1. In this position, the through-flow of transport medium through the duct 1 is practically unimpeded.

At that end of each control plate 13 that is remote from the axle 14, a block plate 15 is provided. This block plate 15 extends from the free or remote end of the control plate 13 downwardly into the associated chute 4 to 9, respectively. The block plates 15 extend downwardly to such an extent that they project into their respective associated chutes 4 to 9 in all pivoted positions of the control plates 13. These block plates 15 are advantageously each formed with a curvature centered on the pivot axle 14 so that, during pivoting of the control plates 13 about their axles 14, only a small space is left between the block plates 15 and upper transverse edges 16 of the chutes 4 to 9; the shape of the block plates 15 is also advantageously adapted to the shape of the upper portions of the feed chutes 4 to 9 as illustrated in the drawing. In this way, passage of fibrous material behind the block plates 15 and beneath the control plates 13 is avoided.

In FIG. 1, each control element 12 has its own pivot axle 14, while in the modification illustrated in FIG. 2 the control plates 13 located between each pair of adjacent feed chutes 4 to 9 are pivotally secured to a common pivot axle 14.

In operation of the transport installation or feeding arrangement shown in FIG. 1, fiber flocks are fed along the duct 1 in the direction of the arrow 2 by a transport fluid flow produced by the blower 3. This assumes that the blower 3 is connected to one end of the duct 1 and the latter is closed downstream of the chute 9 or opens into a return passage. It is important that the same quantity of flock material be fed to each of the chutes 4 to 9 for filling the same. Control of the quantity of flocks fed to the chutes 4 to 9 is effected by those control plates 13 which extend from the pivot axles 14 in the direction of flow of the transport medium (arrow 2). The farther a control plate 13 is pivoted upwardly from its horizontal position, the narrower becomes the flow-through cross-sectional area of the opening for the medium in the duct 1 at the location of the downstream end of the plate 13 that is spaced from the pivot axle 14, and the greater becomes the flow-through speed of the medium at this location. By the same process, immediately downstream of this downstream end of the control plate 13, that is at the upstream end of the chutes 4 to 9, an increase occurs in the flow-through cross-sectional area, and thus deceleration in the flow speed of the medium is encountered at this location. As a result, flock material falls out of the flow and drops into the chutes 4 to 9.

The illustrated transport system or feeding arrangement has the advantage that it is possible readily to reverse the direction of flock transport in the transport duct 1. For this purpose, the duct 1 is closed off or connected to a return passage at the location at which the blower 3 is shown to be located, and a blower 17 is provided at the other end as indicated in dashed lines. In this way the transport medium is moved in the direction of an arrow 18.

In order to regulate the flock quantity delivered into the chutes 4 to 9, the plates 13 previously used for regulation are returned to their horizontal positions, and those control plates 13 which extend from their pivot axles 14 in the direction of flow as indicated by the arrow 18 are used. The explanation already provided above with respect to regulation of the speed of the transport medium in the direction of the arrow 2 applies in a similar manner to the regulation of the speed of the transport medium in the direction of the arrow 18. The provision of the control elements 12 according to the invention thus enables regulation of the flock quantity to be deposited, that is, regulation of the flock quantity entering each chute 4 to 9, independently of the direction of transportation of flocks in the duct 1. Therefore, the possibilities of use of the transport installation are made more versatile than in the prior art installations when the features of the present invention are being used. At the same time, no changes are needed in the configuration of the duct 1 or of the chutes 4 to 9 during such direction reversal. Only the control elements 12 have to be adjusted in their respective positions correspondingly to the operating conditions.

In the modification shown in FIG. 2, the control elements 12 are shown to be formed and arranged in such a manner that they are additionally selectively adjustable into their fully closed positions in which they close the duct 1 to the flow of the transportation medium. Such a closed position of the respective control element 12 is obtained in that the edge of the respective control element 12 which is formed by the control plate 13 and the block plate 15 is brought into contact with a top wall 19 of the duct 1. This is the case in FIG. 2 for the control elements 12 that are located between the chutes 6 and 7.

In operation of the transport system of feeding arrangement depicted in FIG. 2, when the control elements 12 which are located between the chutes 6 and 7 are in their closed positions, the chutes 4–6 are fed with fiber flocks transported in the direction of the arrow 2 and the chutes 7 to 9 are supplied with fiber flocks transported in the direction of the arrow 18. The control plates 13 that are located upstream of the chutes 4 to 6 and 7 to 9, respectively, as considered in the flow directions represented by the arrows 2 and 18, respectively, are adjusted in such a manner that the chutes 4 to 9 are supplied with the desired quatity of the fiber material.

The modification according to FIG. 2 thus permits selection at will of the number of carding machines of a group to which fiber material of one type is to be fed, and the number of carding machines of the same group to which fiber material of another type is to be supplied. Only the control elements 12 are to be correspondingly adjusted to achieve this result, and the positional adjustment of the control elements 12 is an extremely simple operation.

It may be seen from the above that a bottom wall 20 of the duct 1 can be eliminated altogether underneath the control elements 12, since the control elements 12 themselves can be used at these regions to close or complete the duct 1. When common pivot axles 14 are being used for the two control elements 12 that are located between the adjacent ones of the feed chutes 4 to 9, as shown in FIG. 2, the pivot axles 14 are advantageously constituted by shafts which are supported on the two opposite side walls of the duct 1.

Experiments have been carried out with the above-discussed feeding arrangements concerning the flow conditions of the transport medium. The duct 1 used during the experiments had a width of 17 centimeters and a height of 40 centimeters. During one of such experiments, the total supplied transport air quantity was 0.44 $m^3$/sec (cubic meters per second). Six chutes corresponding to the chutes 4 to 9 discussed above were used, and feeding thereof was effected by the transport medium flowing in one direction only through the duct 1. The positions of the control elements 12 shown in FIGS. 1 and 2 do not necessarily correspond to the positions assumed by such control elements 12 during the experiments.

The experiments took into account the fact that, on the one hand, it is sometimes necessary in operation of a mill to be able to shut down individual carding machines of a group, while the others continue to operate, and that, on the other hand, the speed of the transport fluid or medium, that is, the transport air in most instances, should be greater than 2 m/sec (meters per second) and less than 10 m/s, preferably greater than 3 m/s and less than 8 m/s, since at too low transport air speeds, the flocks begin to roll with difficulty, and at too high transport air speeds, they fly over the chutes 4 to 9.

Results with a row of six chutes (as, for example, the chutes 4 to 9 depicted in FIG. 1) are set out in the following table

TABLE 1

| chute | O | M | V | V1 | V2 | V3 | V4 |
|---|---|---|---|---|---|---|---|
| 4 | 400 | .44 | 6.5 | 6.5 | 6.5 | 6.5 | 6.5 |
| 5 | 380 | .37 | 5.8 | 6.8 | 6.8 | 6.8 | 6.8 |
| 6 | 330 | .29 | 5.1 | 6.2 | 7.8 | 7.8 | 7.8 |
| 7 | 290 | .22 | 4.4 | 5.3 | 6.7 | 8.9 | 8.9 |
| 8 | 240 | .15 | 3.7 | 4.4 | 5.4 | 7.1 | 10.8 |
| 9 | 140 | .07 | 3.0 | 3.8 | 4.6 | 6.3 | 9.2 |

wherein
O = the size of the duct opening in the vertical direction upsteam of the respective chute in mm (millimeters)
M = the quantity of air upstream of the respective chute in $m^3$/sec
V = the air speed upstream of the respective chute in m/sec
V1 = the air speed upstream of the respective chute in m/sec when the first chute 4 is closed
V2 = the air speed upstream of the respective chute in m/sec when the first two chutes 4 and 5 are closed
V3 = the air speed upstream of the respective chute in m/sec when the first three chutes 4 to 6 are closed
V4 = the air speed upstream of the respective chute in m/sec when the front four chutes 4 to 7 are closed It will be appreciated that the arrangement of the present invention permits temporary shutdown of up to three of the chutes 4 to 9 if a total of six chutes 4 to 9 is being used. In the possible, but in the practice unlikely, event that four of the six carding machines have to be shut down, the conditions begin to be unfavorable, because the air speed at the first still open chute (that is, in the above-mentioned example, the penultimate chute 8) becomes too high. It can be concluded in general that, with a group of carding machines, the installation or arrangement according to the invention has the advantage of enabling simultaneous shutdown of approximately one-half of such carding machines of the group, without encountering disadvantageous results and without necessitating adjustment of the control elements 12 by resetting.

If, however, according to another apsect of the present invention, the feed of air to the chutes 4 to 9 (that is, to the duct 1) is reduced with increasing number of closures of the chutes 4 to 9, then the conditions become more favorable. With the following quatities of air being supplied to the duct 1:

0.41 $m^3$/sec with one closed chute
0.38 $m^3$/sec with two closed chute
0.36 $m^3$/sec with three closed chutes
0.33 $m^3$/sec with four closed chutes
0.30 $m^3$/sec with five closed chutes, the following air speeds have been obtained with a group of six chutes corresponding to the chutes 4 to 9 of FIG. 1:

TABLE 2

| chute | O | V1 | V2 | V3 | V4 | V5 |
|---|---|---|---|---|---|---|
| 4 | 400 | 6.0 | 5.6 | 5.3 | 4.9 | 4.4 |
| 5 | 380 | 6.4 | 5.9 | 5.6 | 5.1 | 4.6 |
| 6 | 330 | 5.9 | 6.8 | 6.4 | 5.9 | 5.4 |
| 7 | 290 | 5.1 | 5.9 | 7.3 | 6.7 | 6.1 |
| 8 | 240 | 3.9 | 4.7 | 5.9 | 8.1 | 7.4 |
| 9 | 140 | 3.4 | 4.2 | 5.0 | 7.1 | 12.6 |

wherein the significance of the symbols appearing at the top of the various columns is the same as in Table 1, and V5 = the air speed upstream of the respective chute in m/sec when the first five chutes 4 to 8 are closed.

It is clear that, with four of the chutes 4 to 9 closed, the speeds of transport air still lie within the region between 2 m/sec and 10 m/sec. If it, therefore, happens that four of the six carding machines in the group have to be shut down simultaneously, this can be effected by reducing the air quantity flowing into the duct 1, for instance, by specifically provided regulation of the blower motor or by a variation of the transmission ratio of the gear box or transmission, as is well known.

It will be understood that each of the elements described above, or two or more together, may also find a useful application in other types of arrangements differing from the type described above.

While the invention has been described and illustrated as embodied in a feeding arrangement for carding machines, it is not intended to be limited to the details shown, since various modifications and structural changes may be made without departing in any way from the spirit of the present invention. So, for instance, in the arrangement of FIG. 1 as well, the control elements 12 could be mounted for pivoting movements between their fully open and fully closed positions akin to those illustrated and described in connection with FIG. 2. Also, while the effects of sequential closings of the chutes 4 to 9 has been described above, it will be appreciated that, with proper adjustment of the positions of the control elements 12, any arbitrary one or several of the chutes 4 to 9 could be closed at any given time, and the rest of the chutes 4 to 9 would continue to be filled with the flock.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence if the claims.

What is claimed as new and desired to be protected by Letters Patent is set forth in the appended claims.

1. An arrangement for pneumatically transporting fiber flocks to a plurality of carding devices, comprising an elongated duct having a top wall, a bottom wall and two opposite side walls interconnecting said top and bottom walls and bounding a cross-sectionally rectangular passage which has two longitudinally spaced ends and is of a constant cross-sectional area throughout; a plurality of chutes each associated with one of the carding devices and communicating with said passage and extending downwardly from said duct; means for introducing a transporting medium carrying the fiber flocks into at least one of said ends of said passage for flow longitudinally of said passage and for supplying the fiber flocks to the respective chutes; a plurality of control elements each including a control member and a block member rigid with said control member and extending substantially at a right angle thereto; means for mounting said control elements in said duct for pivoting about respective pivot axes longitudinally spaced from the respective chutes and arranged at said bottom wall in such a manner that two of said control elements are arranged between each two of said chutes in a mirror-image fashion with their control members extending from said mounting means toward said chutes and that said block members thereof extend toward the respective chute and into the latter in all pivoted positions of the respective control element; and means for pivoting said control elements between said pivoted positions thereof and for arresting said control elements in selected ones of said pivoted positions.

2. The arrangement as defined in claim 1, wherein one of said pivoted positions is a closed position in which said blocking member of the respective control element blocks the flow of said transporting medium past the same.

3. The arrangement as defined in claim 1, wherein said mounting means includes a common pivot axle for the respective two of said control elements that are arranged between the respective adjacent chutes.

4. The arrangement as defined in claim 1, wherein said pasage has a width of substantially 17 cm and a height of substantially 40 cm.

5. The arrangement as defined in claim 1, wherein said introducing means includes means for introducing the transporting medium with one type of said fiber material into said one end of said passage, and means for introducing the transporting medium with another type of said fiber material into the other end of said passage.

6. The arrangement as defined in claim 1, wherein each of said block members is curved and is centered on a curvature axis that coincides with the pivoting axis of said mounting means.

* * * * *